United States Patent [19]

Eagles

[11] Patent Number: 4,516,807

[45] Date of Patent: May 14, 1985

[54] FLUID SUPPLY SYSTEMS FOR ROTARY CUTTER HEADS FOR MINING MACHINES AND ROTARY CUTTER HEADS COMPRISING FLUID SUPPLY SYSTEMS

[75] Inventor: Brian A. Eagles, Johannesburg, South Africa

[73] Assignee: Coal Industry (Patents) Limited, London, England

[21] Appl. No.: 420,925

[22] Filed: Sep. 21, 1982

[30] Foreign Application Priority Data

Oct. 13, 1981 [GB] United Kingdom ..... 8130875

[51] Int. Cl.[3] ..... E21C 35/22; E21C 35/04

[52] U.S. Cl. ..... 299/1; 299/12; 299/81

[58] Field of Search ..... 299/81, 12, 1

[56] References Cited

U.S. PATENT DOCUMENTS

| | | | |
|---|---|---|---|
| 3,904,246 | 9/1975 | Gandy et al. | 299/12 |
| 3,954,302 | 5/1976 | Browning | 299/81 |
| 4,270,800 | 6/1981 | Barry | 299/1 |
| 4,315,658 | 2/1982 | French et al. | 299/12 |
| 4,465,318 | 8/1984 | Lewis et al. | 299/1 |

FOREIGN PATENT DOCUMENTS

| | | |
|---|---|---|
| 1378456 | 12/1974 | United Kingdom . |
| 1414917 | 11/1975 | United Kingdom . |
| 1452862 | 10/1976 | United Kingdom . |
| 2036830 | 7/1980 | United Kingdom . |
| 2062725 | 5/1981 | United Kingdom . |

*Primary Examiner*—Stephen J. Novosad
*Assistant Examiner*—Mark J. Del Signore
*Attorney, Agent, or Firm*—Stevens, Davis, Miller & Mosher

[57] ABSTRACT

A rotary cutter head drivably mountable on a rotary drive shaft of a mining machine comprises a hub assembly drivably mountable on the drive shaft and a barrel component secured around the hub assembly. Ventilating means comprising tubular elements are mounted within the barrel component and define passages along which air flow inducing sprays are directed from nozzles. The nozzles are mounted on a distributor block constituting part of the fluid feed system for the cutter head.

5 Claims, 3 Drawing Figures

FLUID SUPPLY SYSTEMS FOR ROTARY CUTTER HEADS FOR MINING MACHINES AND ROTARY CUTTER HEADS COMPRISING FLUID SUPPLY SYSTEMS

This invention relates to fluid supply systems for rotary cutter heads for mining machines.

In particular, although not exclusively, the present invention relates to water feed systems to nozzles mounted on or adjacent to the rotary cutter heads for coal mining machines.

Frequently, when a rotary cutter head is used to break coal from a longwall coal face there is a tendency for dust to be generated and for methane emitted from the broken coal to concentrate around the rotating cutter head which is operating in a buttock shielded from the main ventilation air flow. Such a concentration of methane can be potentially dangerous, especially if the methane is allowed to collect in the vicinity of the cutting zone of the cutter head until its concentration is within the explosive range, i.e. 5% to 15% by volume of methane. Once the concentration of methane is within this range it is possible for a spark generated by a cutter tool striking an intrusion in the coal face to ignite the methane which in turn could give rise to an explosion.

It has been proposed to provide ventilating means on the rotary cutter head, the ventilation means comprising an air flow guide tube and a liquid spray arranged to induce an air flow along the air flow guide tube.

Previously, the nozzles for the liquid sprays have been mounted directly on to the air flow guide tube which requires the relatively high pressure fluid feed to be fed from a feed pipe extending along an axial bore provided in the rotary drive shaft upon which the rotary cutter head is mounted, and via a distributor block to external hoses hydraulically connecting the distributor block with the nozzles.

An object of the present invention is to provide an improved fluid supply system which tends to overcome problems associated with the use of external hoses in the arduous conditions encountered adjacent to a rotary cutter head of a mining machine.

According to the present invention, a fluid supply system for a rotary cutter head for a mining machine comprises a fluid feed arrangement for feeding pressurised fluid from an inlet port on the mining machine to a distributor block for mounting within the rotary cutter head, the distributor block defining a passage for fluid flow and a number of nozzles adapted to emit air flow inducing sprays, the nozzles being in hydraulic connection with the passage defined by the distributor block and being mounted on the distributor block.

The present invention also provides a rotary cutter head drivably mountable on a rotary drive shaft of a mining machine, the shaft having an axially extending bore, the rotary cutter head comprising a hub assembly drivably mountable on the drive shaft, a barrel component secured around, and co-axial with, the hub assembly, air flow inducing means comprising a passage defined by a tubular element mounted within the barrel component, and nozzle means for directing an air flow inducing spray along the passage defined by the tubular element, and a fluid supply system for feeding pressurised fluid from an inlet port mountable adjacent to the mining machine along a tube extendable along the axially extending bore of the drive shaft to a distributor block defining a passage, the nozzle means being hydraulically connected to the passage defined by the distributor block and being mounted on the distributor block.

Preferably, the distributor block is secured to the hub assembly.

Conveniently, the passage defined by the distributor block hydraulically connects with an annular channel provided in the distributor block, the nozzle means comprising a plurality of nozzles angularly arranged around the distributor block and in hydraulic connection with the annular channel, the ventilating means comprising a plurality of tubular elements associated with the nozzles, respectively.

Conveniently, the nozzles are arranged such that the axis of the air flow inducing spray is inclined to the longitudinal axis of passage defined by the associated tubular element.

Preferably, sensor means are provided for sensing the total flow of fluid to the nozzles.

Advantageously, the sensor means is adapted to actuate an alarm and/or cut off power supply to the machine if the sensed flow falls below a preselected volume.

By way of example one embodiment of the present invention will be described with reference to the accompanying drawings in which.

Figure 1:
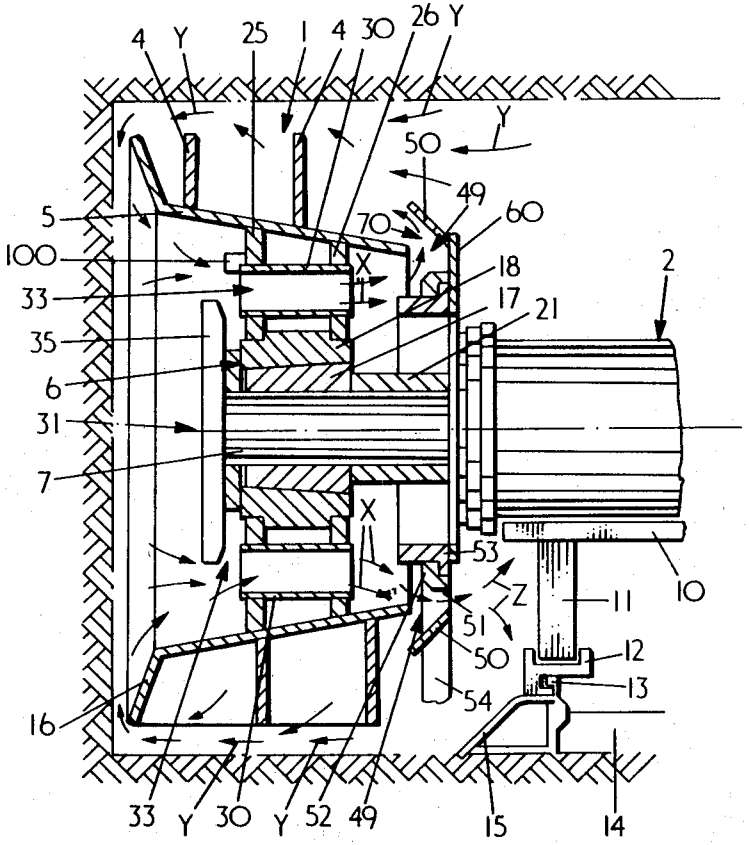
FIG. 1 is an incomplete partly sectional view taken through a rotary cutter head of a mining machine.

The drawings show a rotary cutter head 1 of a well known shearer type coal winning mining machine 2 (only a portion of the cutting section of which is shown) which in use repeatedly traverses to and fro along a longwall face with the rotary cutter head winning coal from the working face. The coal is cut by a plurality of cutter tools (not shown) mounted around the periphery of the cutter head, the cutter tools being mounted in tool holders (not shown) carried on the radially outer extremities of a plurality of cut mineral loading vanes 4 extending helically around and axially along a generally frustro conical barrel component 5 fixedly mounted with respect to a hub assembly 6 drivably mounted on a drive shaft 7 extending from the cutting section of the mining machine. The cutting section may be constituted by a portion of the machine body as indicated in FIG. 1. Alternatively, the cutting section may be constituted by a ranging arm pivotally mounted on the machine body.

As shown in FIG. 1, the machine body is carried on an underframe 10 provided with legs 11 having shoes 12 for slidably engaging elongate rails 13 fixedly mounted on an armoured flexible conveyor 14 extending along the longwall face. The shoe 12 shown in FIG. 1 rests on and is guided by the outer face of the conveyor which also supports a ramp plate 15.

The barrel component 5 also is provided with a generally frustro conical annular back plate 16 forming the working face side of the cutter head 1 and carrying a plurality of tool holders (not shown) for cutting tools (not shown).

Figure 3:
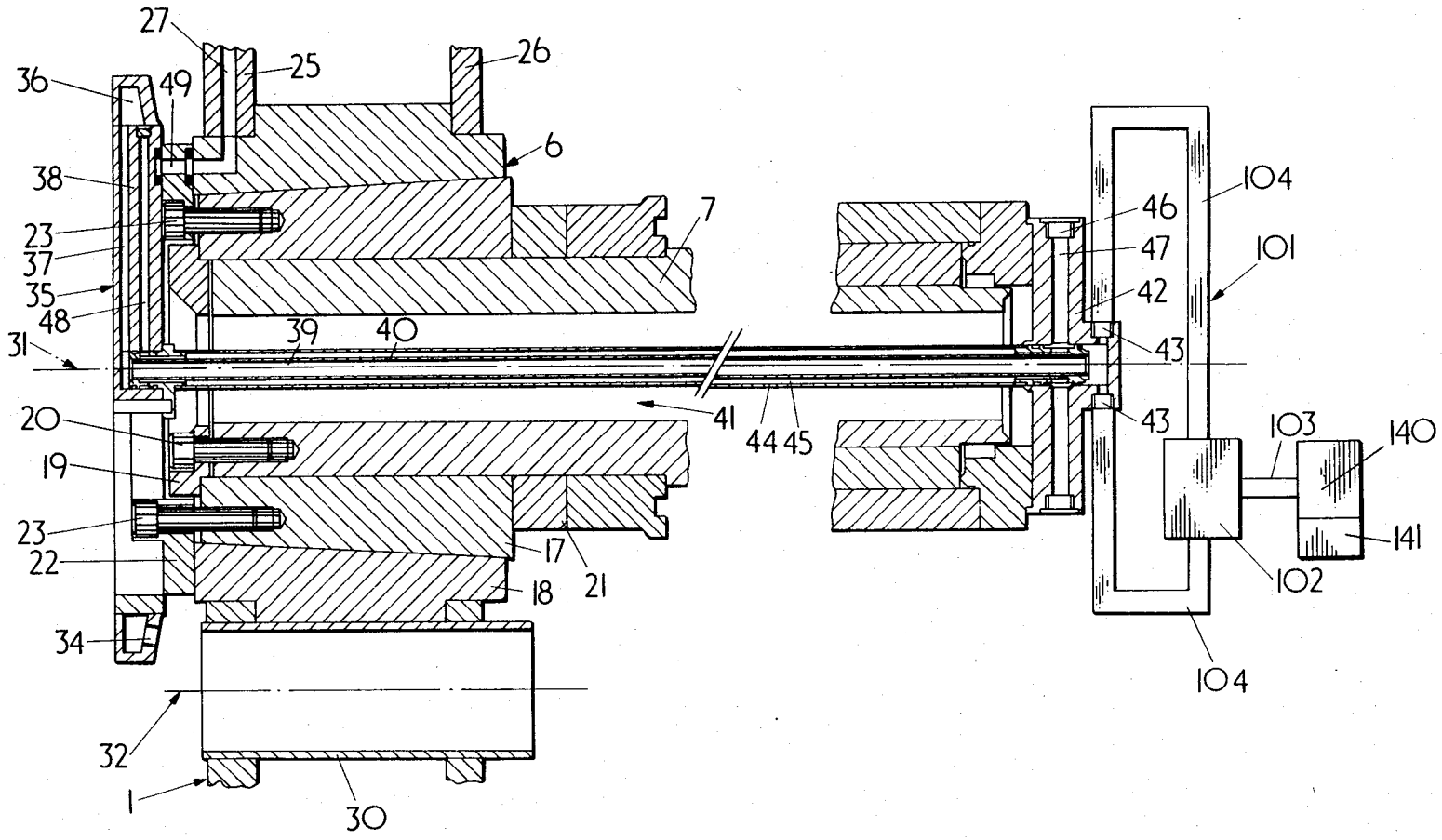
FIG. 3 is an incomplete sectional view taken through a hub portion of the rotary cutter head of FIG. 1 and shown on an enlarged scale.

The hub assembly 6 which is shown in detail in FIG. 3 comprises a wedge lock bush arrangement 17, 18 for drivably connecting the cutter head to the drive shaft 7. The inner bush element 17 is retained on the shaft by an end retaining plate 19 secured to the shaft by bolts 20 and having a lip overlapping the working face side of the inner bush element, the element being prevented from sliding further along the shaft by spacer members 21.

The relatively outer bush element 18 has a conical wedge surface which co-operates with the conical wedge surface presented by the inner bush element 17. Thus, the outer bush element is drivably connected to the drive shaft via the inner bush element. A further retaining plate 22 secured to the inner bush element by bolts 23 ensures the wedge assembly cannot accidently become disengaged.

The barrel component 5 is fixedly mounted on to the hub assembly 6 by two plates 25, 26 welded to cut outs in the outer bush assembly 18 and to the inwardly directed surface of the barrel component. The plate 25 and outer bush element 18 have passages 27 for feeding dust suppression fluid (i.e., water) to the cutting zone of the cutter head as will be explained later in this specification.

The cutter head 1 comprises ventilating means including a plurality of tubular elements 30 angularly arranged around the rotational axis 31 of the drive shaft and hub assembly, the tubular elements being welded into cut outs provided in the plates 25 and 26 so as to form through passages extending from the working face side of the cutter head to the machine side of the cutter head. In the drawings the axes 32 of the tubular elements are arranged generally parallel to the axis of rotation of the hub assembly. However, in other embodiments the axes of at least some of the tubular elements are inclined relatively to the hub assembly axis. In use, an air flow is induced to flow along the passages of the tubular elements by fluid sprays 33 emitted from nozzle means 34 provided on a distributor block 35 secured to the hub assembly by bolts (not shown), the axis of each spray 33 being inclined to the longitudinal axis of the passage defined by the associated tubular element 30.

The distributor block 35 comprises an annular channel 36 extending around the block to feed pressure fluid to the plurality of nozzles 34, the channel having an input passage 37 extending along a radially extending arm 38. The passage 37 is in hydraulic connection with a passage 39 provided by a rotatably mounted inner tube 40 extending along a through bore 41 formed in the drive shaft 7. The machine side of the rotatable tube 40, (i.e., the end remote from the distributor block) is sealably mounted in an adaptor unit 42 fixedly secured to the cutting section of the machine. Pressurised fluid is fed to the passage 39 via ports 43 and a flexible hose trailing behind the mining machine from a relatively high pressure source (not shown).

An outer tube 44 arranged around the inner tube 40 provides an annular passage 45 connecting feed ports 46 and passages 47 with a passage 48 which is provided in the aforementioned radially extending arm 38 and which hydraulically connects with the aforementioned passage 27 provided in the plate 25 and outer bush element 18 via a short interconnecting passage 49 provided in the retaining plate 22. The feed ports 46 are in hydraulic connection with a source of relatively low pressure fluid via a flexible trailing hose (not shown) arranged to trail behind the mining machine as it traverses along the face, the relatively low pressure fluid being fed along the passages 47, 45, 48, 49 and 27 to spray nozzles (not shown) mounted on the loading vanes adjacent the cutting zone of the cutter head and directed towards the cutting tools. Alternatively, or in addition to the spray nozzles associated with the cutting zone, spray nozzles may be provided on the loading vanes or on the barrel component 5 and arranged to direct sprays along the passages for cut mineral defined by the loading vanes. These spray nozzles which are not shown in the accompanying drawings may be of a type similar to those disclosed in the assignee's prior British patent specification Nos. 1,414,917 and 2,062,725.

The cutter head also includes air flow deflector means comprising an inclined annular guide plate 50 (see FIGS. 1 and 2) which is mounted on radially extending arms 51 (only one of which is shown) extending from a support hub 52 to define a plurality of elongate apertures 49 effectively extending all around the support hub. The support hub 52 is fixedly mounted on a mounting arrangement 53 for a loading cowl (only a small portion of the arm 54 of which is shown). In use, the loading cowl tends to retain cut rock or mineral within the pockets defined by the loading vanes and co-operates with the helical loading vanes to urge cut rock and mineral towards the conveyor 14. In use, the loading cowl is located adjacent to the rear of the cutter head as the mining machine traverses along the longwall face. Thus, when the machine reaches the end of a traverse and reverses its direction of motion, it is necessary for the loading cowl to be swung approximately 180° about the axis 31 of the drive shaft in order to be relocated at the opposite side of the cutter head. As the cowl is swung about the axis 31 the inclined deflector guide plate 50 which is fixedly mounted relative to the cowl also swings about the axis. However, as the apertures 49 provide an effectively continuous opening extending annularly all around the support hub 52 the condition of the opening effectively remains unchanged. A blanking plate 60 fixedly mounted relative to the cutting section of the mining machine blanks off the apertures 49 associated with the relative upper region of the deflector guide 50 (see FIGS. 1 and 2). FIG. 1 shows the blanking plate 60 slidably contacting the machine side end of the inclined plate 50 effectively closing the apertures 49 in the relative upper region to restrict air flow towards the machine in that region of the cutter head. However, where the blanking plate is not effective (as seen in the relative lower region of the inclined deflector guide shown in FIG. 1) the apertures 49 are open and air flow towards the machine in this region is permitted. The purpose of this arrangement will be made clear later in the specification.

Figure 2:
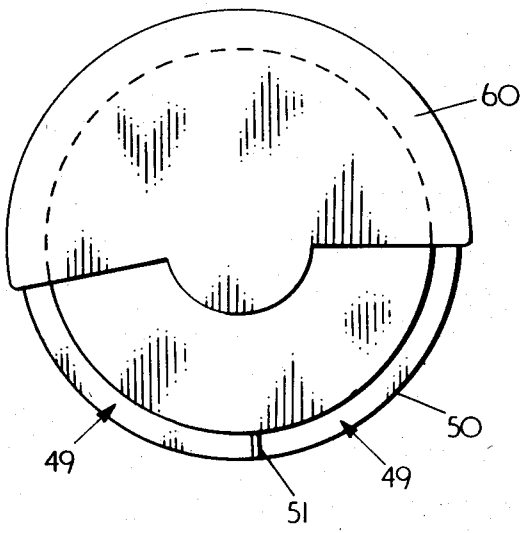
FIG. 2 is an incomplete end view of a detail of FIG. 1.

FIG. 2 illustrates the extent of the area for which the blanking plate 60 is effective. In this particular example the relative upper region of the apertures 49 is closed for approximately 200°.

Such an arrangement ensures that in use when the loading cowl is swung about the axis 31 of the drive shaft, irrespective of the angular position of the cowl, the relative lower region of the apertures 49 is always open to permit air flow from the cutter head towards the machine, the relative upper region of the apertures 49 always remaining closed to air flow towards the mining machine.

In FIG. 1 it can be seen that the inclined deflector guide 50 is located adjacent to the machine side end margin of the barrel component 5 and is arranged to project radially outwardly beyond the adjacent end portion of the barrel component to define an annular aperture 70. The angle of the deflector guide is preferably within the range of 5° to 45° from a line normal to the axis of rotation 31 of the drive shaft (i.e., as seen in FIG. 1 from 5° to 45° from a substantially vertical plane).

Preferably, the inclined deflector guide 50 is arranged such that the minimum cross-sectional area of the aperture 70 defined between the barrel component and the inclined deflector guide is at least as great as the total minimum cross-sectional area of the passages defined by the tubular element 30.

In use, as the machine is traversing along the longwall face with the cutter head 1 winning rock or mineral from the working face, pressure fluid at a relatively low pressure is fed via ports 46 as previously explained to the spray nozzles provided on the cutter head to suppress dust generated by the cutting tools. Simultaneously, relatively high pressure fluid is supplied to ports 43 and hence via passages 39 and 37 and the channel 36 to the nozzles 34 associated with each of the tubular elements 30 such that air flow inducing sprays are directed along the passages defined by the tubular elements such that air flow within the barrel component 5 is induced to flow along a first path section in a general direction towards the machine side end of the cutter head, as indicated generally by arrows X in FIG. 1. The action of ventilating means 34, 30 also induces air flow along a second path section radially outside the barrel component 5 and in a general direction away from the mining machine side of the cutter head. The air flow along the second path section is indicated generally by arrow Y.

In the relative upper region of the cutter head the induced air flow flowing along the first path section and in a general direction towards the mining machine side of the cutter head is deflected by the combined effect of the blanking plate 60 and inclined deflection guide 50 such that the air flow flowing along the first path section in this region of the cutter head is urged towards the air flow flowing along the second path section and thereby a preselected portion of the air flow together with some water from the air flow inducing sprays tends to be recirculated within the cutter hea.

In the relative lower region of the cutter head the induced air flow flowing along the first path section and in a general direction towards the mining machine side of the cutter head is permitted to pass through the open apertures 49 to be discharged along a third path section indicated generally by arrows Z from the cutter head into the main ventilation air flow along the longwall face.

The preselected portion of the air flow and associated water from the air flow inducing sprays which is recirculated within the cutter head is determined by the angular extent of the blanking plate 60 and the angle of inclination of the deflection guide 50. It will be appreciated that the greater the angular extent of the blanking plate the greater is the portion of the air flow which is recirculated and vice versa.

The effect of recirculating the air flow tends to reduce the nuisance condition of wet air being discharged into the working zone by the face operators. In addition, the water which is recirculated with the air flow tends to be mixed with the cut material momentarily being conveyed within the pockets defined by the loading vanes 4 and thereby tends to wet the cut material. Thus, as the material is conveyed along the conveyor system including the conveyor 14 there tends to be reduced dust made especially as the wetted material is passed over transfer stations.

Any dust generated within the zone of the cutter head tends to be drawn along the second air flow path section around the working face side of the cutter head and into the air flow passages defined by the tubular elements 30 where it is efficiently wetted by the air flow inducing sprays 33 from the nozzles 34. The wetted dust is carried along the first air flow path section and is either deflected by the deflector means 50, 60 to be mixed with the cut material momentarily within the loading pockets or to be discharged towards the mining machine and conveyor 14 through the open apertures 49 currently within the relatively lower region of the cutter head. Dust concentration within the cutting zone also tends to be reduced by the effect of the aforementioned sprays mounted on the loading vanes or on the barrel component.

Any methane produced within the cutting zone tends to be drawn with the induced air flow to be discharged in a diluted state through the same open apertures 49 currently within the relative lower region of the cutter head or recirculated by the plate 60 in the upper region.

The present invention provides an improved cutter head which tends to reduce or control dust concentrations occurring within the cutting zone to an acceptably low level, the amount of water used being maintained within an acceptably low volume. Also, methane concentrations in the vicinity of the cutting zone are controlled to within desirable limits.

FIG. 1 shows the cutter head to be provided with a gas and/or air flow sensor 100 arranged to sense a preselected state existing in the vicinity of the cutter head, as for example, the concentration of methane existing in the vicinity of the cutter head and to derive a signal indicative of the sensed concentration. The sensor may be mounted on the working face side of the tubular elements 30 (as indicated). Alternatively, or in addition to, one or more sensors may be mounted on the machine side of the tubular elements 30. It is probable that sensors mounted on the working face side of the tubular elements will sense the methane concentration and that sensors mounted on the machine side of the tubular elements will sense air flow conditions, the latter sensor arranged to sense air flow volume and/or pressure. The derived signal is fed along cables (not shown) to processor means (not shown) mounted either on the mining machine or on a control panel mounted at the end of the working face remote from the machine. The processor means is arranged to receive the derived signal and to switch off the power supply to the mining machine should the sensed gas concentration reach or approach a preselected critical value. Alternatively, or in addition to, the processor means activates an alarm should the sensed gas concentration reach or approach a preselected critical value.

An air flow sensor would be arranged to sense the flow rate of the air flow and would be adapted to derive a signal indicative of the sensed flow rate. The sensor may sense the flow rate by detecting the pressure of the air flow and in which case the sensor would be adapted to derive a signal indicative of the sensed pressure.

Turning now to FIG. 3, the broken lines adjacent the right-hand side of the drawing indicate a fluid flow sensor arrangement 101 which is built into the relatively high pressure water supply to the nozzles 34 in the distributor block 35 and which is adapted to sense a preselected operational condition of the water supply to the nozzles 34. The arrangement comprises a fluid flow and/or fluid pressure sensor unit 102 fed with relatively high pressure water through a connector pipe 103 which in turn is connected to the aforementioned relatively high pressure source via a flexible trailing hose. The output of the flow sensor unit 102 is connected via connectors 104 to the two inlet ports 43 of the previously described relatively high pressure water system within the cutter head.

The sensor unit 102 is adapted to sense the flow of water to the relatively high pressure system and to derive a signal indicative of the flow. The derived signal is fed to a processor unit 140 including alarm means 141 and arranged to receive the signal and to de-activate the machine by switching off the power supply to the mining machine should the sensed flow fall below a preselected volume. Alternatively, or in addition to the flow sensor, the sensor unit may include a fluid pressure sensor arranged to sense the fluid pressure supply and to derive a signal of pressure supply. The signal de-activating the machine if the pressure reaches a preselected critical value. Thus, in operation should any one of the nozzles 34 become blocked or inoperative for any reason the flow sensor unit 102 senses the resultant reduction in water flow, the derived signal is carried accordingly and the processor means actuates control means to switch off the machine. Such an arrangement tends to ensure that if any of the nozzles 34 does become blocked or inoperative such that no air flow inducing spray is directed along the passage of the associated tubular element 30, then the machine is halted. Such an arrangement may be considered necessary when working in conditions where no recirculation of air flow within the barrel component can be tolerated or where only a preselected amount of recirculation can be tolerated. It will be understood that should any one of the sprays become blocked or inoperative then an air flow might be urged to flow along the passage of the associated tubular element in a reverse direction, i.e., away from the mining machine side of the cutter head and towards the working face side of the cutter head. Thus, recirculation of air flow would tend to take place within the barrel component and a resultant excessive build up in methane concentration within the cutting zone could occur. However, by providing the flow sensor arrangement including the unit 102 such a potentially dangerous condition would tend to be avoided.

In other embodiments the unit 102 is adapted to activate an alarm if the water flow falls below a preselected volume.

In other embodiments of the invention a common fluid feed system is provided for the air flow inducing nozzles 34 and for the nozzles arranged to direct sprays towards the cutting zone. With such embodiments flow and/or pressure restrictors may be provided to effectively reduce the flow and/or pressure fed to the nozzles arranged to direct sprays towards the cutting zone.

The previously discussed two tubes 40, 44 may be retained with a common fluid supply system, for example, the inner tube 40 being used to feed the relatively high pressure fluid to feed passages within the distributor block and the annular passage defined by the outer tube 44 being used to house electrical cables for feeding the signal from the aforementioned gas sensor 100.

I claim:

1. A fluid supply system for a rotary cutter head of a mining machine, comprising a fluid feed arrangement for feeding pressurized fluid from an inlet port on the mining machine along a tube extending axially of the rotary cutter head to a distributor block within the rotary cutter head mounted for rotation therewith, the distributor block further defining a first and second passage means for low and high pressure fluids and a radially extending passage for said high pressure fluid in hydraulic connection with an annular passage extending around the distributor block for fluid flow, and a plurality of nozzles adapted to emit air flow inducing sprays, the nozzles being provided on the distributor block in hydraulic connection with the annular passage defined by the distributor block.

2. A rotary cutter head drivably mounted on a rotary drive shaft of a mining machine, the shaft having an axially extending bore, the rotary cutter head comprising a hub assembly drivably mountable on the drive shaft, a barrel component secured around and co-axial with, the hub assembly, air flow inducing means comprising a plurality of passages angularly spaced around the axis of rotation of the rotary drive shaft within the barrel component, nozzle means for directing air flow inducing sprays along the plurality of passages, and a fluid supply system for feeding pressurized fluid from an inlet port mounted adjacent to the mining machine along a tube extending along the axially extending bore of the drive shaft to a distributor block mounted within said barrel for rotation therewith, said distributor block defining first and second passage means for low and high pressure fluids with a radially extending passage for said high pressure fluid in hydraulic connection with an annular passage extending around the distributor block, the nozzle means being provided on the distributor block in hydraulic connection with the annular passage defined by the distributor block.

3. A head as claimed in claim 1, in which the nozzles are arranged such that the axis of the air flow inducing spray is inclined to the longitudinal axis of passage defined by the associated tubular element.

4. A head as claimed in claim 3, in which sensor means are provided for sensing the total flow of fluid to the nozzles.

5. A head as claimed in claim 4, in which the sensor means is adapted to actuate an alarm and/or cut off power supply to the machine if the sensed flow falls below a preselected volume.

* * * * *